US006732663B2

(12) United States Patent
Tsai

(10) Patent No.: US 6,732,663 B2
(45) Date of Patent: May 11, 2004

(54) FOLDABLE TABLE

(76) Inventor: Ping Chen Tsai, Tang-Jia Village, Gong Ming Town, Shenzhen City, Guand Dong (CN)

( * ) Notice: Subject to any disclaimer, the term of this patent is extended or adjusted under 35 U.S.C. 154(b) by 181 days.

(21) Appl. No.: 10/093,013

(22) Filed: Mar. 6, 2002

(65) Prior Publication Data

US 2003/0167981 A1 Sep. 11, 2003

(51) Int. Cl.[7] ..... A47B 9/00
(52) U.S. Cl. ..... 108/132; 108/91
(58) Field of Search ..... 108/115, 92, 132, 108/133, 131, 129, 130, 161, 91; 248/439, 188.6, 188.91, 188

(56) References Cited

U.S. PATENT DOCUMENTS 2,695,828 A * 11/1954 Witkowiak ..... 108/132
6,112,674 A * 9/2000 Stanford ..... 108/132
6,422,157 B2 * 7/2002 Rumph ..... 108/132
6,431,092 B1 * 8/2002 Stanford ..... 108/132
6,471,173 B1 * 10/2002 Tseng ..... 248/439
6,520,094 B2 * 2/2003 Wen ..... 108/132

FOREIGN PATENT DOCUMENTS

DE 3011797 * 10/1981

* cited by examiner

*Primary Examiner*—Jose V. Chen
(74) *Attorney, Agent, or Firm*—Raymond Y. Chan; David & Raymond Patent Group

(57) ABSTRACT

A foldable table includes a tabletop and a table supporting frame substantially supporting the tabletop thereon. The tabletop has an upper utilizing portion which has a top resting edge peripherally encircling therearound, and a bottom bottom supporting surface for the table supporting frame to be mounted thereon. The tabletop further has an engaging rim downwardly protruded from the bottom supporting surface to form an outer edge thereof and to define a storage cavity within the engaging rim, wherein the engaging rim has an engaging edge groove formed thereon which is shaped and sized to fittedly receive the top resting edge. Whereby, one foldable table is capable of securely stacking on another foldable table by making the top resting edge of the lower foldable table to receive in the engaging edge groove of the upper foldable table.

20 Claims, 6 Drawing Sheets

FOLDABLE TABLE

BACKGROUND OF THE PRESENT INVENTION

1. Field of Invention

The present invention relates to folding furniture, and more particularly to a portable foldable table with enhanced supporting structure and storage arrangement which allow the foldable table to be more secure and can be more conveniently stored as compared to related conventional arts.

2. Description of Related Arts

The transportable utility renders the foldable tables being useful for various kinds of activities, such as annual meetings in school's hall, church gathering, beverage reception in a particular university's podium, exhibitions, and the likes. Very often, these participant-intensive activities take place in multi-function rooms or designated areas in which the related furniture and equipments are temporary set up. After the functions, all the furniture and equipments will be cleared from the multi-function rooms or the designated areas and neatly stored to, say, other storage room for further uses, and the multi-function rooms or the designated areas will be made over for other purposes.

Foldable tables are usually utilized by function's host to support or retain the necessary equipments in that they are foldable and portable so that they can be easily set up when necessary, and removed after the functions ended. A conventional foldable table usually comprises a tabletop having an upper utilizing surface and a lower attaching surface, a foldable table frame which comprises a pair of table leg frames pivotally mounted on the lower attaching surface of the tabletop in a foldable manner.

Regarding to such conventional foldable table, some deep-seated drawbacks can be found. First, foldable tables are hard to stack up. Foldable tables are prevalent because of their flexibility. When needed, they can be unfolded for retaining and supporting a variety of objects. When they are not needed, they can be folded up into a relatively compact size for storage. Of course, most of the conventional foldable tables allow user to fold up their legs in order to make them more compact. There is nothing wrong with each individual foldable table. However, many organizations need lots of foldable tables for large-scale functions, storing a large number of them is another story. Typically, one may erect the folded foldable tables one by one and overlappedly lay them in order. One potential problem of this practice is that the foldable tables easily collapse. In order to prevent them from collapsing, some sorts of strings or ropes may have to be used to tighten them. In other cases, one may wish to stack up all the foldable tables. However, the user may not be able to do so simply because the upper one may not be able to securely stack on the lower one.

Second, the foldable table may not be secure enough. In order that the foldable table to be portable, the material used for manufacturing the tabletop should be light in weight, such as plastic. This can be easily justified by the fact that most of the conventional foldable tables have their tabletops made by some sorts of plastic. However, light material probably suffers from inadequate strength, making the foldable table not secure enough, especially when it is loaded with fairly heavy objects. Though some manufacturers employ light but strong material, such as fiber reinforced composites, the foldable table made by this kind of material is unavoidably expensive which decreases the willingness of consumers to buy this product. One may choose to sacrifice the portability of the foldable table by building the tabletop with heavier and more rigid material. Nonetheless, portability and rigidity are mutually contending.

Besides, almost all conventional foldable tables have their respective tabletop supported at four corner portions, or at several separate supporting points along the edge portion of the tabletop. However, very often, an object will be placed at the middle portion of the tabletop. This creates a large bending moment to the tabletop and, if the tabletop was not strong enough, it would be broken or deflected after being used for a period of time. Also, with such kinds of mechanical designs, any loading loaded on the tabletop will not be evenly shared among the foldable table frame.

Finally, foldable tables are usually bulky in size, even though their weights are relatively light. Therefore, when someone wants to move a particular foldable table, he/she may not be able to so do because of the bulky size. He/she even can't find a gripping portion of the foldable table. The usual way is to call another person to help him/her. The conventional foldable tables, even when folded, usually require more than one people to move.

SUMMARY OF THE PRESENT INVENTION

A main object of the present invention is to provide a foldable table which can be easily and securely stacked up for convenient storage without involving any complicated mechanical process or equipments.

Another object of the present invention is to provide a foldable table which has enhanced rigidity as compared with conventional arts without significantly increasing its overall weight.

Another object of the present invention is to provide a foldable table wherein a tabletop is substantially and evenly supported by a foldable table frame so as to enhance the overall strength of the foldable table.

Another object of the present invention is to provide a foldable table which is easy to carry and transport even by one people only.

Another object of the present invention is to provide a foldable table which does not involve complicated mechanical structure, so as to minimize the manufacturing cost and other related expenses of the foldable table.

Accordingly, in order to accomplish the above objects, the present invention provides a foldable table comprising:

a tabletop having an upper utilizing portion, a top resting edge integrally and peripherally extended around the tabletop, and a lower supporting portion, the tabletop further having an engaging rim downwardly protruded from the supporting surface to form an outer edge of the tabletop and to define a storage cavity within the engaging rim, wherein the engaging rim has an engaging edge groove, having a depth with respect to a height of the engaging edge rim, indently formed at an inner surface thereof, wherein the engaging edge groove is shaped and sized for fittedly engaging with the top resting edge; and a table supporting frame which comprises:

a pair of leg frames pivotally and spacedly supported underneath the supporting surface in such a manner that the leg frames are capable of folding between a folded position and an unfolded position, wherein in the folded position, each of the leg frames is pivotally folded to receive in the storage cavity at a position above the engaging edge groove, wherein in the unfolded position, each of the leg frames is pivotally folded out of the storage cavity at a predetermined unfolded angle between each of the leg frames with the supporting surface; and means for retaining the leg frames in the folded position;

means for retaining the leg frames in the unfolded position;

whereby, the foldable table is adapted to overlappedly stack on another foldable table by engaging the top resting edge of a lower foldable table in the engaging edge groove of the foldable table with the upper utilizing portion of the lower foldable table is received in the storage cavity of the foldable table, while the top resting edge of the lower foldable table is encircled by the engaging rim of the foldable table so as to substantially retain the two foldable tables in position in the overlapped manner and to avoid a lateral relative movement between the two foldable tables.

DETAILED DESCRIPTION OF THE PREFERRED EMBODIMENT

Figure 1:
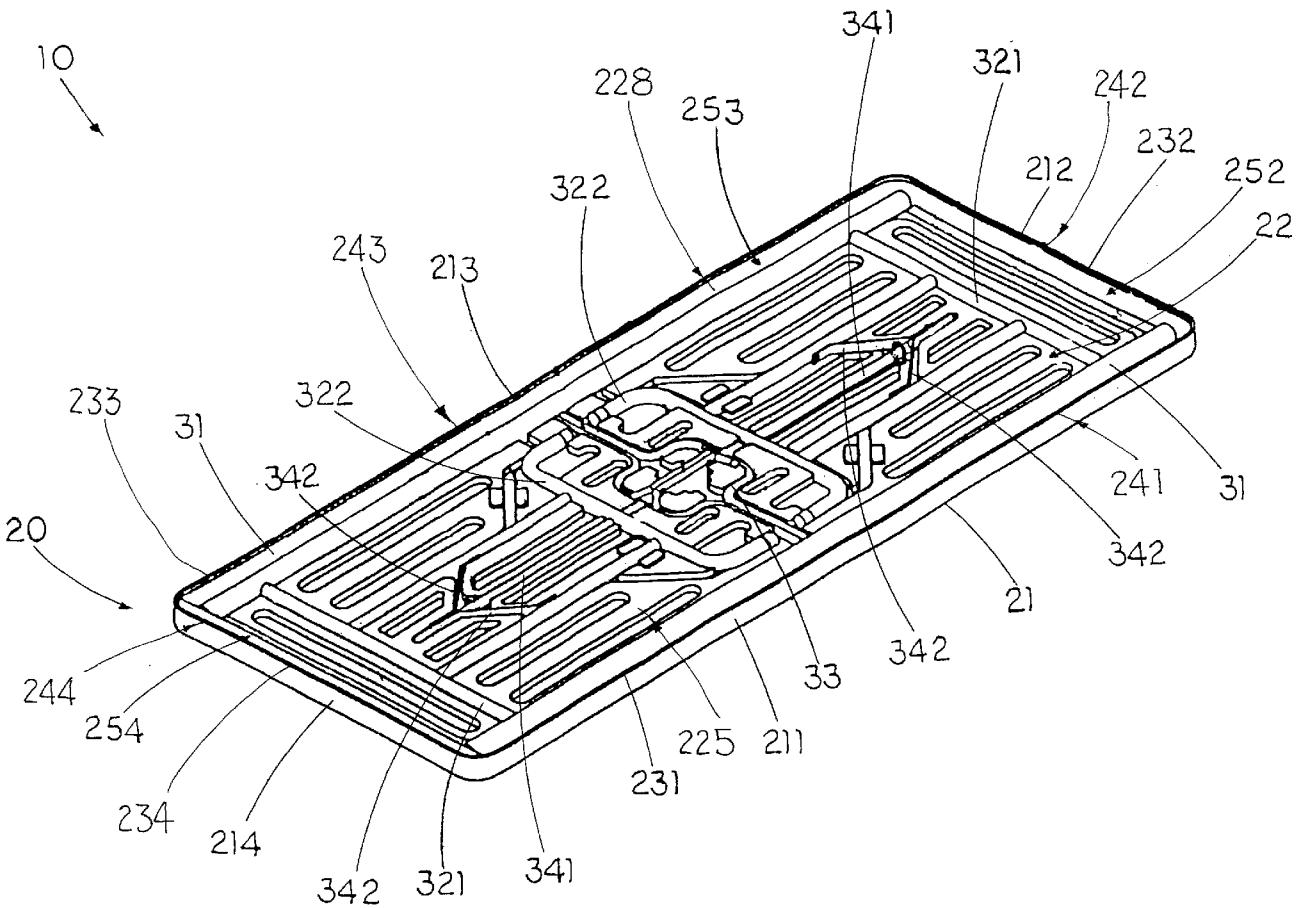
FIG. 1 is a perspective view of the foldable table according to the above first preferred embodiment of the present invention, illustrating that the leg frames are in folded position.

Referring to FIG. 1 of the drawings, a foldable table 10 according to a first preferred embodiment of the present invention is illustrated. According to the first preferred embodiment of the present invention, the foldable table 10 comprises a tabletop 20 and a table supporting frame 30 substantially supporting the tabletop 20 thereon.

Figure 2:
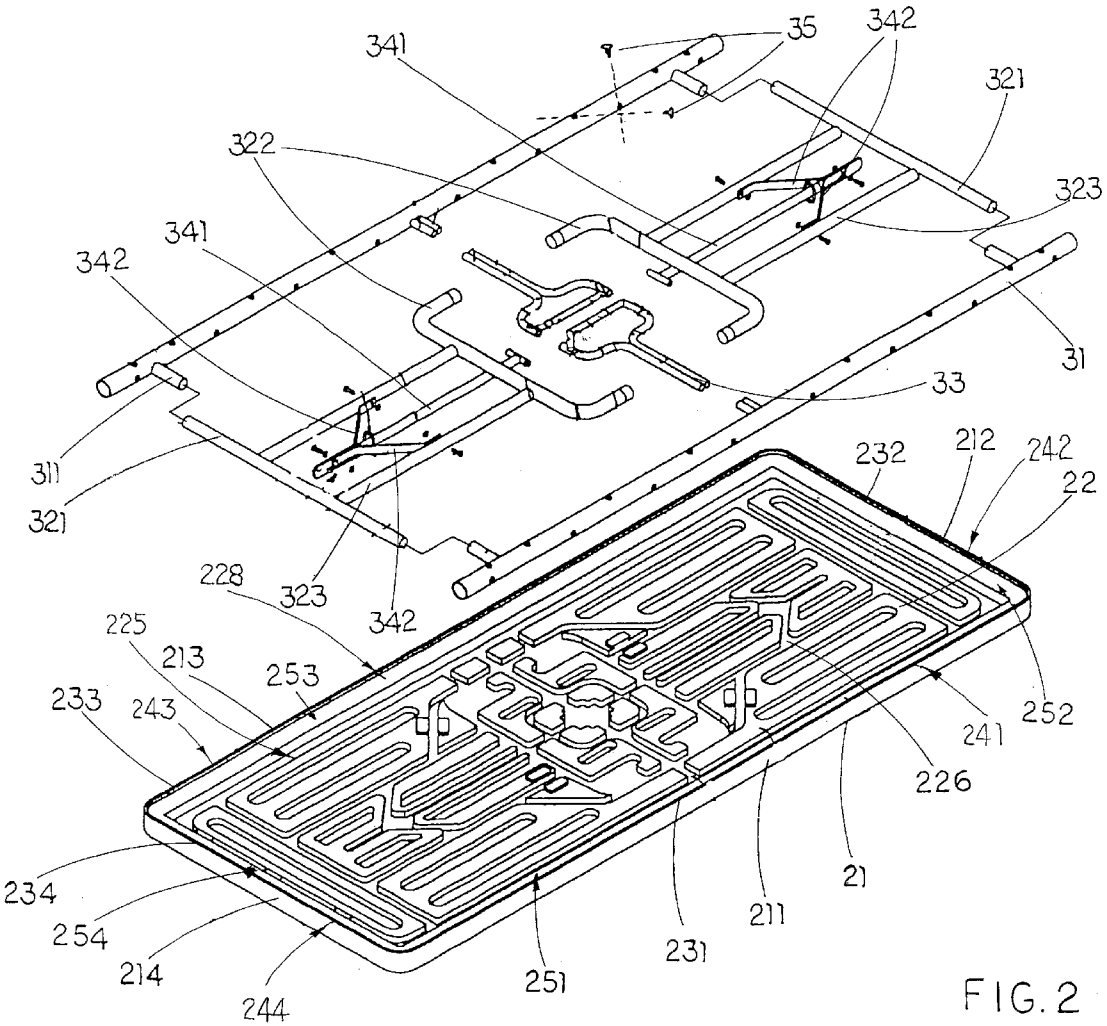
FIG. 2 is an exploded perspective view of the foldable table according to the above first preferred embodiment of the present invention.

Referring to FIGS. 1 to 2 of the drawings, the tabletop 20 has an upper utilizing portion having a top utilizing surface 21, and a lower supporting portion having a bottom supporting surface 22. The upper utilizing portion of the tabletop 20 is embodied as rectangular in shape having first through four sections of top resting edge 211, 212, 213, 214 integrally and peripherally extended around the upper utilizing portion, wherein the first and the third sections of the top resting edge 211, 213 are opposite to each other and the second and the fourth sections of the top resting edge 212, 214 are opposite with each other. According to the first preferred embodiment, the first and the third sections of the top resting edge 211, 213 have equal length which is larger than that of the second and the fourth sections of the top resting edge 212, 214 which also have equal length, The lower supporting portion has first through four sections of the side edge portion 221, 222, 223, 224 which integrally extended from fist through four sections of the top resting edge 211, 212, 213, 214 of the upper utilizing portion respectively. The tabletop 20 further has first through four sections of engaging rim 231, 232, 233, 234 downwardly and integrally protruded from first through four side edge portions 221, 222, 223, 224 of the bottom supporting surface 22 to form first through fourth sections of outer covering edge thereof 241, 242, 243, 244 and to define a storage cavity 225 within the four sections of the engaging rim 231, 232, 233, 234. The four sections of the engaging rim 231, 232, 233, 234 have first through four sections of engaging edge groove 251, 252, 253, 254 indently formed thereon respectively wherein the four sections of the engaging edge groove 251, 252, 253, 254 are shaped and sized such that they are adapted for receiving first through four sections of the top resting edge 211, 212, 213, 214 therein respectively. The depth of the storage cavity 225 is made greater than that of the engaging edge groove 251, 252, 253, 254.

The table supporting frame 30 comprises a pair of strengthening members 31, a pair of leg frames 32 and a handle frame 33. The pair of strengthening members 31 is provided along the first and the third side edge portions 221, 223 so as to substantially support the tabletop 20 and evenly distribute any loading loaded on the tabletop 20 to the leg frames 32.

Referring to FIGS. 1 to 4 of the drawings, the leg frames 32 are pivotally mounted beneath the bottom supporting surface 22 between the pair of strengthening members 31 in such a manner that they are spacedly apart from each other and they are capable of folding between a folded position and an unfolded position, wherein in the folded position, the leg frames 32 are pivotally folded toward the bottom supporting surface 22 to receive in the storage cavity 225, wherein in the unfolded position, the leg frames 32 are pivotally unfolded out of the storage cavity 225 to stand on the ground which supports the foldable table 10. When the leg frames 32 are in folded position, the leg frames 32 and the engaging edge groove 251, 252, 253, 254 surround around the engaging rim 231, 232, 233, 234, wherein a receiving cavity 228 is defined above the folded leg frames 32 received in the storage cavity 225, i.e. between bottom sides of the folded leg frames 32 and the outer covering edge 241, 242, 243, 244 of the engaging rim 231, 232, 233, 234, and surrounded by the engaging edge groove 251, 252, 253, 254. Moreover, each of the leg frames 32 is pivotally unfolded to form a predetermined unfolded angle between the corresponding leg frame 32 and the bottom supporting surface 22. Preferably, the unfolded angle should be around 90 degrees according to the preferred embodiment.

Figure 4:
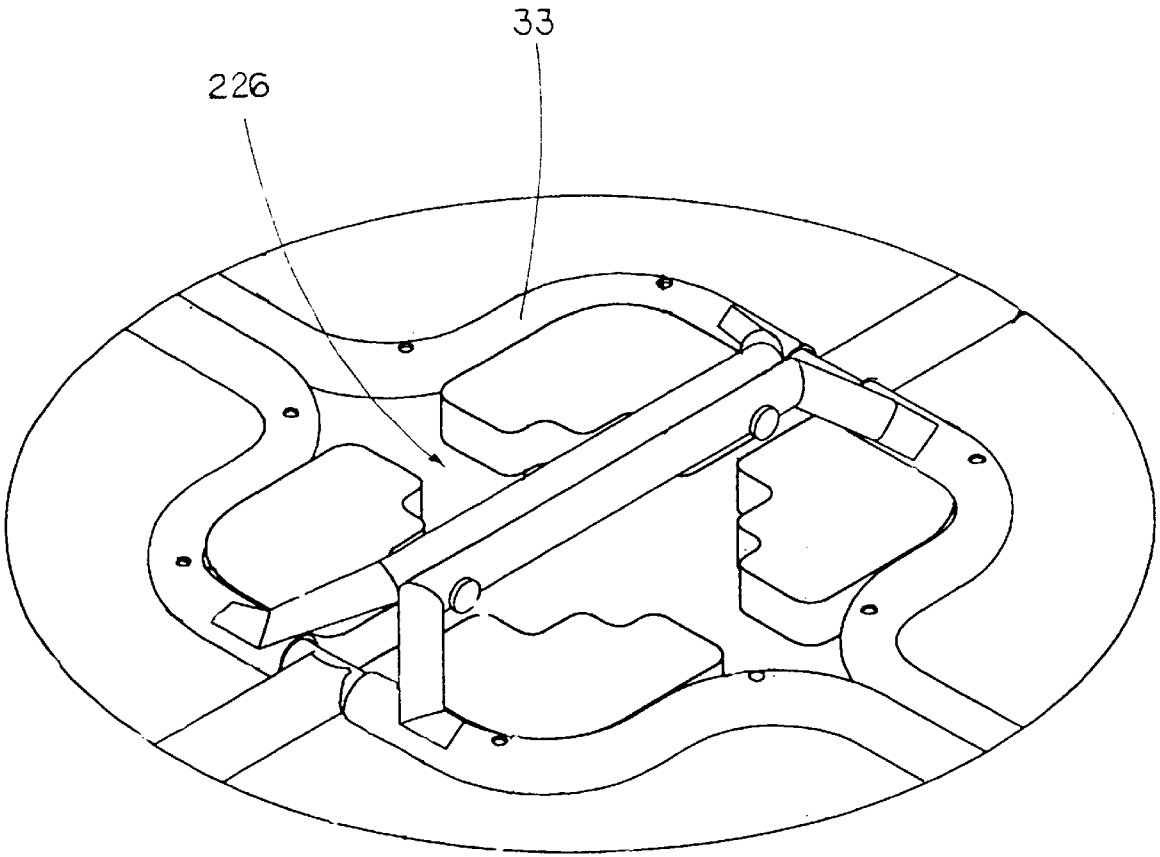
FIG. 4 is a perspective view of the handle frame according to the above first preferred embodiment of the present invention.

The handle frame 33, as shown in FIG. 4, is securely mounted on the middle portion of the bottom supporting surface 22 and extended between the pair of strengthening member 31. The handle frame 33 comprises a pair of handle bars protruded out from the bottom supporting surface 22 and bent to form a handle loops side by side mounted on the bottom supporting surface 22 for a user to grip thereon. Since the handle frame 33 is mounted at the middle portion of the tabletop 20, it not only facilitates gripping for easy carrying, but also reinforces supporting ability of the tabletop 20, and specifically reinforces the strength of the middle portion of the tabletop 20.

It is worth to mention that the center of gravity of the foldable table 10 is expected to be around the middle portion of the tabletop 20, therefore, when a user grip on the handle loop which is located on the middle portion of the tabletop 20, the user should be able to lift up and carry the whole foldable table 20 easily without any unbalanced weight distribution. In other words, the foldable table 20 allows easy carrying even when only one person is going to carry it.

The table supporting frame 30 further comprises means for retaining the pair of leg frames 32 in their unfolded position. The unfolded retaining means comprises a pair of retaining frames 34 extended between the leg frames 32 and the handle frame 33 respectively in a pivotally movable manner so as to securely retain the pair of leg frames 32 in its unfolded position. By pivotally moving the pair of retaining frames 34, the pair of leg frames 32 can be folded or unfolded.

The table supporting frame 30 further comprises a plurality of connecting elements 35 for mounting the pair of strengthening members 31 on the bottom supporting surface 22. On the other hand, the bottom supporting surface 22 further has a plurality of receiving grooves 226 formed thereon wherein two of the receiving grooves 226 are arranged for fittedly and securely receiving the strengthening members 31 therein. According to the first preferred embodiment, the two strengthening members 31 are elongated bars longitudinally provided along the first and the third side edge portions 221, 223 of the bottom supporting surface 22. Accordingly, the two receiving grooves 226 that receive the strengthening members are longitudinally formed on the first and the third side edge portions of the bottom supporting surface 22. Thus, the two strengthening members 31 which are received inside the two receiving grooves 226 respectively are capable of substantially providing line support to the tabletop 20 of the foldable table 10 of the present invention.

Remark that, as alternatives, the strengthening members 31 can be of any cross-sectional shape apart from circular as in the above first preferred embodiment.

Each of the connecting elements 35, such as a bolt, is arranged to penetrate through the strengthening members 31 to the sidewalls of the receiving grooves 226 that receive the strengthening members 31 in a cross manner so as to maximize the mounting strength.

The plurality of receiving grooves 226 are arranged not only to fittedly receive the strengthening members 31 as described above, but also to fittedly receive the leg frames 32, the reinforcing frame 33 and the retaining frames 34.

The table supporting frame 30 further comprises means for retaining the legs frames 32 in their folded position. The folded retaining means comprises a plurality of retaining elements 36 integrally and inwardly protruded from a sidewall of each of the receiving grooves 226. The retaining elements 36 are elastic in nature so that when the leg frames 32 are received inside the two of the receiving grooves 226 respectively, the retaining elements 36 of each of the receiving grooves 226 that receive the leg frames 32 will hold the leg frames 32 in position, i.e. prevent them from moving out from the receiving grooves 226. When the user wants to unfolded the leg frames 32, the user has to apply a pulling force to the leg frames 32 which slightly squeezes the elastic retaining elements 36 so as he/she can be able to pull out the leg frames out from the receiving grooves 226.

Each of the leg frames 32 comprises an upper tubular pivot arm 321, a lower legs member 322 and a pair of connecting members 323 integrally extended between the upper tubular pivot arm 321 and the lower legs member 322. The lower legs member 322 is sized and shaped to stand on a ground.

The tubular pivot arm 321 of each of the leg frames 32 has two ends pivotally mounted to the two strengthening members 31 respectively. With regard to the mounting, each of the strengthening members 31 further has two mounting protrusions 311 integrally and sidewardly protruded therefrom, wherein the mounting protrusions 311 are arranged to fittedly insert into two ends of the respective tubular pivot arm 321 in a pivotally movable manner. With these arrangements, the two ends of each of the pivot arms 321 are substantially supported by the mounting protrusions 311 of the strengthening members 31.

The retaining frames 34 comprises first and second pivot joints provided beneath the bottom supporting surface 22 of the tabletop 20 at a position between the handle frame 33 and the two leg frames 32 respectively. Each of the retaining frames 34 further comprises a supporting arm 341 having a first end portion 3411 pivotally connected to one of the pivot joints of the tabletop 20, and a pair of folding arms 342 each having a leg end 3421 pivotally connected to the connecting members 323 of one of the leg frame 32 respectively and a connecting end 3422 pivotally connected to second end portion 3412 of the supporting arm 341. Thus, by pivotally folding the retaining frames 34, one is capable of folding and unfolding the leg frames 32.

The supporting arm 341 further has a folding stopper 3413 integrally and outwardly protruded from the second end portion 3412 for stopping the pivotal movement of the pair of folding arms 342 when the frame legs are in unfolded position. Thus, when the leg frames 32 are in folded position, the supporting arm 341 and the folding arms 342 are pivotally folded up to receive in the receiving grooves 226 of the bottom supporting surface 22. When the leg frames 32 are in unfolded position, the supporting arm 341 and the folding arms 342 are pivotally unfolded until the one of the folding arms 342 biases against the folding stopper 3413 so as to prohibit any further unfolding pivotal movement of the leg frames 32 and therefore to retain the leg frames 32 in their unfolded position. Accordingly, the folding stopper 3413 is provided in such a manner that when one of the folding arms 342 biases against the folding stopper 3413, the leg frames 32 make the predetermined unfolded angle with the bottom supporting surface 22.

Figure 3:
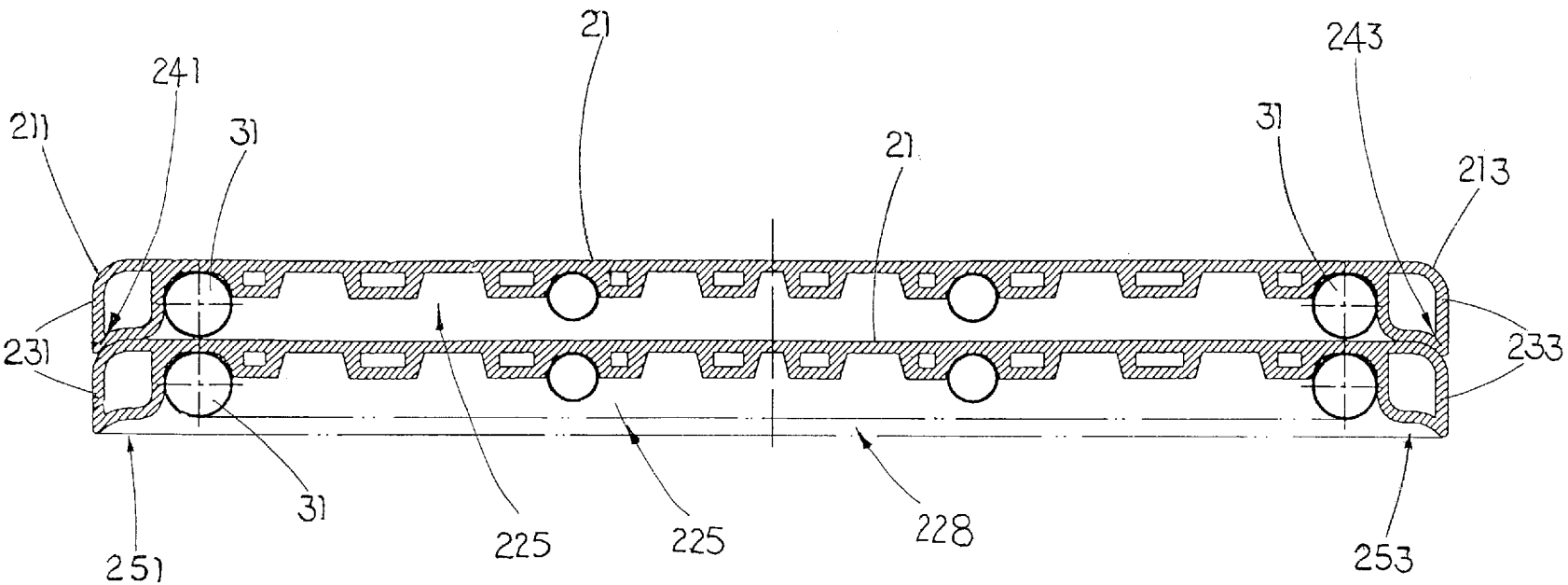
FIG. 3 is a front view of the foldable tables according to the above first preferred embodiment of the present invention, illustrating that a numbers of foldable tables can be stacked up together.

Referring to FIG. 3 of the drawings, in order to enable the stacking mechanism as mentioned in forgoing paragraphs, the table supporting frame 30 should be completely received into the storage cavity 225 when the leg frames 32 are in unfolded position, so that the sections of the engaging edge groove 251, 252, 253, 254 are capable of engaging with the sections of the top resting edge 211, 212, 213, 214 of another foldable table 10 of the present invention. In other words, the height of the tabletop 20 should be slightly greater than the thickness of the table supporting frames 30 when the leg frames 32 are in unfolded position.

When the foldable table 10 of the present invention is in needed, one can simply take it away from storage, and unfold the leg frames 32 to their unfolded position. When the leg frames 32 are totally unfolded, i.e. in the unfolded position, the foldable table 10 should be erected on the ground and ready for use. When the foldable table 10 is not in use, one can just simply fold up the leg frames 32 to receive in the receiving cavity 228. If more than one foldable tables 10 are utilized, the user can stack up all the foldable tables 10 by engaging the engaging edge groove 251, 252, 253, 254 of the upper foldable table 10 with the top resting edge 211, 212, 213, 214 of the lower foldable table 10.

When the foldable table 10 of the present invention is in needed, one can simply take it away from storage, and unfold the leg frames 32 to their unfolded position. When the leg frames 32 are totally unfolded, i.e. in the unfolded position, the foldable table 10 should be erected on the ground and ready for use. When the foldable table 10 is not in use, one can just simply fold up the leg frames 32 to receive in the storage cavity 225. If more than one foldable tables 10 are utilized, the user can stack up all the foldable tables 10 by engaging the engaging edge groove 251, 252, 253, 254 of the upper foldable table 10 with the top resting edge 211, 212, 213, 214 of the lower foldable table 10.

It is worth to remark that, though the above description only provide a first embodiment of the present invention, any obvious alternative of the above first preferred embodiment which employs the spirit of the present invention should also be covered and protected. For instances, the shape of the tabletop 10, instead of being rectangular, or more broadly quadrilateral, can be of any shape including circular which only has one endless top resting edge and engaging rim.

It is also worth to mention that, as an alternative, the handle frame can further comprise a pair of reinforcing members extended from the handle loops toward first and third side edge portions 221, 223 of the bottom supporting surface 22 respectively so as to provide additional reinforcing support to the middle portion of the tabletop 20.

Figure 5:
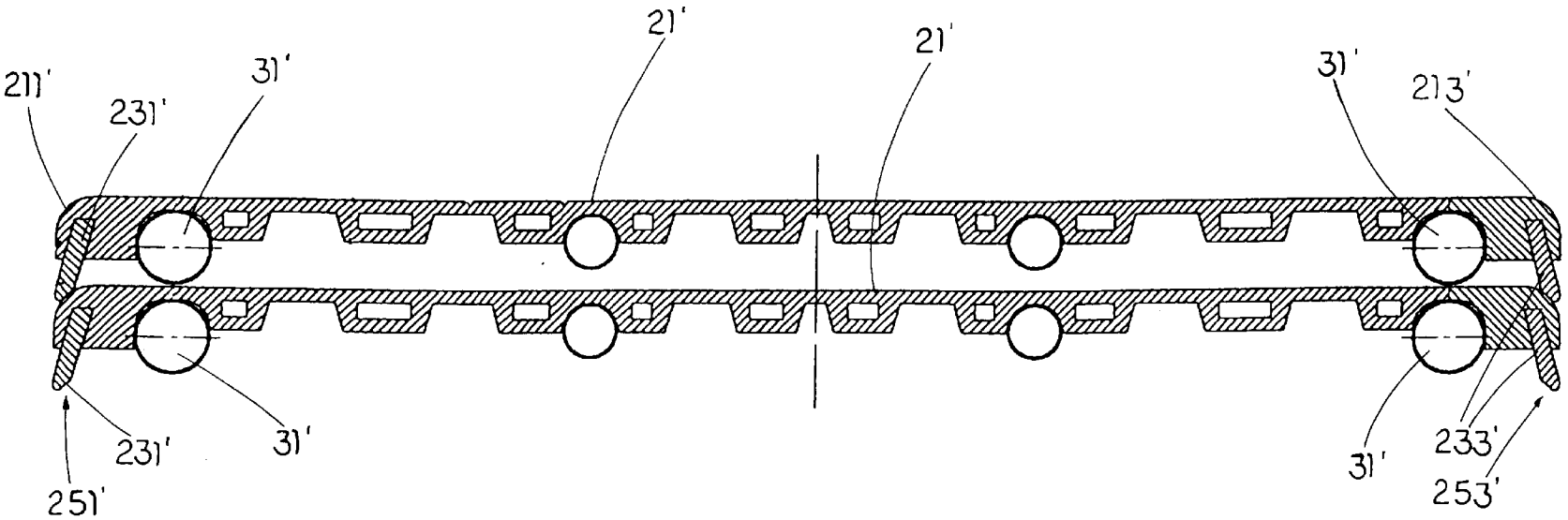
FIG. 5 is a first alternative mode of a front view of the foldable tables according to the above first preferred embodiment of the present invention, illustrating that a numbers of foldable tables can be stacked up together.

Referring to FIG. 5 of the drawings, a first alternative mode of the foldable table 10' according to the above first preferred embodiment of the present invention is illustrated. According to the alternative mode, the tabletop 10' further has first through fourth sections of attaching groove 261', 262', 263', 264' formed along the side edge of the bottom supporting surface 22, wherein each of the sections of the engaging rim 231', 232', 233', 234' has an upper attaching portion securely received in the respective attaching groove 261', 262', 263', 264', and a lower engaging portion inclinedly and outwardly extended from the bottom supporting surface 22', wherein the engaging edge groove 251', 252', 253', 254' are formed on inner sides of the engaging portions of the engaging rim 231', 232', 233', 234' respectively. According to the first alternative mode, the engaging rim 231', 232', 233', 234' are made of rubber or other similar materials so as to increase the frictional force between the engagement rim 231', 232', 233', 234' of the upper foldable table 10' and the top resting edge 211', 212', 213', 214' of the lower foldable table 10' when two foldable tables 10' are stacked together.

Figure 6:
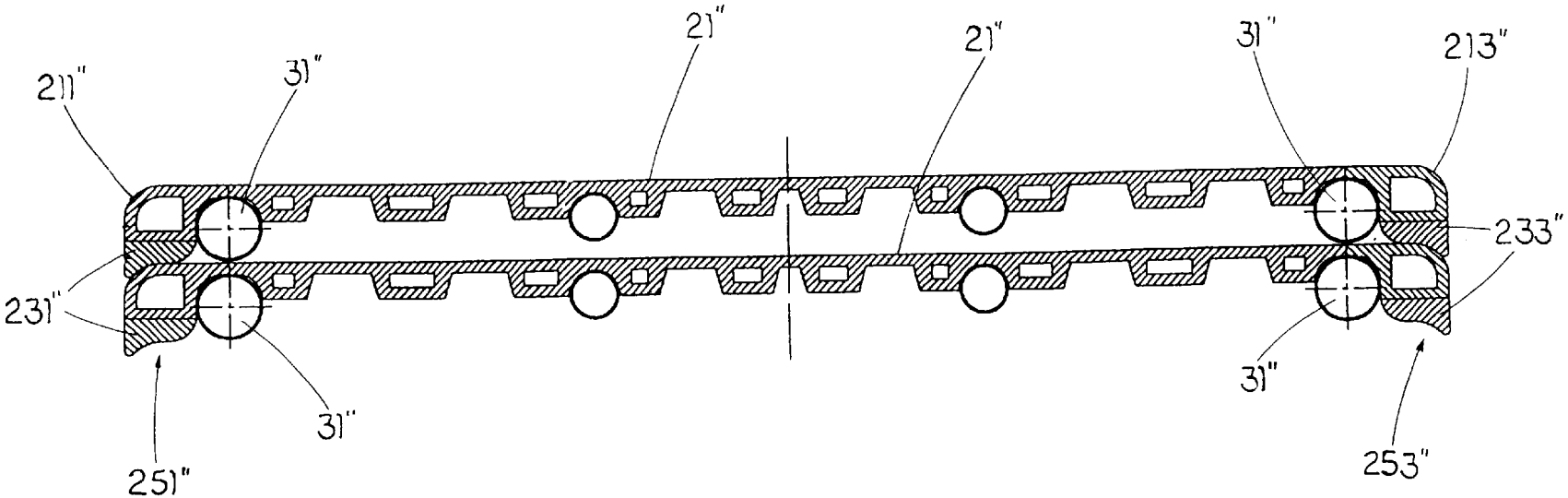
FIG. 6 is a second alternative mode of a front view of the foldable tables according to the above first preferred embodiment of the present invention, illustrating that a numbers of foldable tables can be stacked up together.

Referring to FIG. 6 of the drawings, as a second alternative, each of the sections of the engaging rim 231", 232", 233", 234" has a top surface firmly attached to the bottom surface 22" of the tabletop 20" to form the respective sections of the engaging edge groove 251", 252", 253", 254". The engaging rim 231", 232", 233", 234" can be, as mentioned in the first alternative, made of rubber or material that possesses high coefficient of friction so as to increase the frictional force between the engagement rim 231", 232", 233", 234" of the upper foldable table 10" and the top resting edge 211", 212", 213", 214" of the lower foldable table 10" when two foldable tables 10" are stacked together.

In view of the above, the present invention substantially achieves the above-mentioned objects and has the following advantages:

(1) Capable of being easily stacked when the leg frames is folded.

(2) Having enhanced rigidity as compared with conventional arts without significantly increasing the overall weight.

(3) The tabletop is substantially and evenly supported by the foldable table frame so as to enhance the overall strength of the foldable table.

(4) Having a handle for facilitating easy carrying.

What is claimed is:

1. A foldable table, comprising:

a tabletop, including an upper utilizing portion having a top resting edge integrally and peripherally extended around said upper utilizing portion and a lower supporting portion having a bottom supporting surface formed thereon, wherein said lower supporting portion has an engaging rim integrally and downwardly extended from said bottom supporting surface to form an outer edge of said lower supporting portion and to define a storage cavity within said engaging rim and has an engaging edge groove indently and peripherally formed along an inner surface of said engaging rim that defines a predetermined depth, wherein said engaging edge groove is shaped and sized corresponding to a shape and size of said top resting edge; and a table supporting frame which comprises:

a pair of leg frames pivotally and spacedly affixed to said bottom supporting surface in such a manner that said leg frames are capable of folding between a folded position and an unfolded position, wherein in said folded position, each of said leg frames is pivotally folded inwardly to be received in said storage cavity;

means for retaining said leg frames in said folded position, wherein a receiving cavity is defined between the leg frames being folded and received in said storage cavity and an outer covering edge of said engaging rim and surrounded by said engaging edge groove; and means for retaining said leg frames in said unfolded position, wherein in said unfolded position, each of said leg frames is pivotally folded out of said storage cavity to perpendicular to said tabletop; and;

whereby said foldable table is adapted to overlappedly stack on another foldable table by receiving said upper utilizing portion of said another foldable table in said receiving cavity of said foldable table while said top resting edge of said upper utilizing portion of said another foldable table is engaged in said engaging edge groove and surrounded by said engaging rim of said foldable table so as to substantially retain said two foldable tables in position and avoid a lateral relative movement between said foldable table and said another foldable tables.

2. The foldable table, as recited in claim 1, wherein said top resting edge of said tabletop has a rounded edge surface integrally extended from said upper utilizing portion toward said engaging rim in such a manner that rounded edge surface of said top resting edge is adapted for fittedly engaging with an inner surface of said engaging edge groove.

3. The foldable table, as recited in claim 2, wherein said tabletop further has a attaching groove formed along said side edge portion of said bottom supporting surface, wherein said engaging rim has an upper attaching portion securely received in said attaching groove, and a lower engaging portion inclinedly and outwardly extended from said bottom supporting surface, wherein said engaging edge groove is formed on an inner side of said engaging portion of said engaging rim.

4. The foldable table, as recited in claim 3, wherein said table supporting frame further comprises a pair of strengthening members longitudinally provided on two side edge portions of said bottom supporting surface for substantially strengthening said side edge portions of said bottom supporting surface.

5. The foldable table, as recited in claim 4, wherein said bottom supporting surface further has a plurality of receiving grooves indently formed thereon for fittedly receiving a portion of said pair of strengthening members respectively while said strengthening members are received inside said storage cavity.

6. The foldable table, as recited in claim 5, wherein said table supporting frame further comprises a plurality pairs of connecting elements for securely mounting said pair of strengthening members in said receiving grooves respectively, wherein each pair of said connecting elements being arranged to inclinedly penetrate through said strengthening members to respective sidewalls of said two receiving grooves in a cross manner, so as to maximize a mounting strength of said connecting elements.

7. The foldable table, as recited in claim 6, wherein each of said leg frames comprises a upper tubular pivot arm having two ends pivotally mounted to said strengthening members respectively, wherein each of said strengthening members further has two mounting protrusions integrally protruded therefrom, said mounting protrusions being adapted to fittedly inserted into said ends of said tubular pivot arms respectively in a pivotally movable manner, so that said two ends of each of said tubular pivot arms are substantially supported by said respective mounting protrusions.

8. The foldable table, as recited in claim 7, further comprising a handle frame substantially mounted on a middle portion of said bottom supporting surface of said tabletop at a position between said strengthening members so as to allow a user to be gripped thereon.

9. The foldable table, as recited in claim 1, further comprising a handle frame substantially mounted on a middle portion of said bottom supporting surface of said tabletop at a position between said strengthening members so as to allow a user to be gripped thereon.

10. The foldable table, as recited in claim 1, wherein said tabletop further has a attaching groove formed along said side edge portion of said bottom supporting surface, wherein said engaging rim has an upper attaching portion securely received in said attaching groove, and a lower engaging portion inclinedly and outwardly extended from said bottom supporting surface, wherein said engaging edge groove is formed on an inner side of said engaging portion of said engaging rim.

11. The foldable table, as recited in claim 10, wherein said table supporting frame further comprises a pair of strengthening members longitudinally provided on two side edge portions of said bottom supporting surface for substantially strengthening said side edge portions of said bottom supporting surface.

12. The foldable table, as recited in claim 11, wherein said bottom supporting surface further has a plurality of receiving grooves indently formed thereon for fittedly receiving a portion of said pair of strengthening members respectively while said strengthening members are received inside said storage cavity.

13. The foldable table, as recited in claim 12, wherein said table supporting frame further comprises a plurality pairs of connecting elements for securely mounting said pair of strengthening members in said receiving grooves respectively, wherein each pair of said connecting elements being arranged to inclinedly penetrate through said strengthening members to respective sidewalls of said two receiving grooves in a cross manner, so as to maximize a mounting strength of said connecting elements.

14. The foldable table, as recited in claim 13, wherein each of said leg frames comprises a upper tubular pivot arm having two ends pivotally mounted to said strengthening members respectively, wherein each of said strengthening members further has two mounting protrusions integrally protruded therefrom, said mounting protrusions being adapted to fittedly inserted into said ends of said tubular pivot arms respectively in a pivotally movable manner, so that said two ends of each of said tubular pivot arms are substantially supported by said respective mounting protrusions.

15. The foldable table, as recited in claim 14, further comprising a handle frame substantially mounted on a middle portion of said bottom supporting surface of said tabletop at a position between said strengthening members so as to allow a user to be gripped thereon.

16. A foldable table, comprising:

a tabletop having an upper utilizing portion and a lower supporting portion having a bottom supporting surface; and a table supporting frame which comprises:

a pair of leg frames pivotally and spacedly supported by said bottom supporting surface in such a manner that said leg frames are capable of folding between a folded position and an unfolded position, wherein in said folded position, said leg frames are pivotally folded on said bottom supporting surface, wherein in said unfolded position, each of said leg frames is pivotally folded out from said bottom supporting surface at a predetermined unfolded angle between each of said leg frames with said bottom supporting surface;

a handle frame substantially mounted on a middle portion of said bottom supporting surface of said tabletop;

means for retaining said leg frames in said unfolded position; and means for retaining said leg frames in said folded position.

17. The foldable table, as recited in claim 16, wherein said handle frame comprises a pair of handle bars outwardly extended from said bottom supporting surface and bent to form two handle loops respectively side by side mounted on said bottom supporting surface of said tabletop.

18. The foldable table, as recited in claim 17, wherein said table supporting frame further comprises a pair of strengthening members longitudinally provided on two side edge portions of said bottom supporting surface for substantially strengthening said side edge portions of said bottom supporting surface.

19. The foldable table, as recited in claim 18, wherein said bottom supporting surface further has a plurality of receiving grooves indently formed thereon for fittedly receiving a portion of said pair of strengthening members respectively.

20. The foldable table, as recited in claim 19, wherein said table supporting frame further comprises a plurality pairs of connecting elements for securely mounting said pair of strengthening members in said receiving grooves respectively, wherein each pair of said connecting elements being arranged to inclinedly penetrate through said strengthening members to respective sidewalls of said two receiving grooves in a cross manner, so as to maximize a mounting strength of said connecting elements.

* * * * *